US011237518B2

(12) United States Patent
Araki et al.

(10) Patent No.: US 11,237,518 B2
(45) Date of Patent: Feb. 1, 2022

(54) IMAGE FORMING APPARATUS, METHOD, AND COMPUTER-READABLE MEDIUM FOR PREVENTING FAILURES AND ERRORS IN DRUM MEMORY AND BELT MEMORY DUE TO HOT-SWAPPING

(71) Applicant: Brother Kogyo Kabushiki Kaisha, Nagoya (JP)

(72) Inventors: Toshinori Araki, Hekinan (JP); Tatsuro Yokoi, Nagoya (JP); Seiya Sato, Yokkaichi (JP); Shinta Sugiura, Nagoya (JP); Koji Akagi, Inazawa (JP); Masaaki Wakizaka, Nagoya (JP); Keita Inoue, Nagoya (JP); Osamu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/986,365

(22) Filed: Aug. 6, 2020

(65) Prior Publication Data

US 2021/0041831 A1 Feb. 11, 2021

(30) Foreign Application Priority Data

Aug. 9, 2019 (JP) ..... JP2019-146923

(51) Int. Cl.
*G03G 21/18* (2006.01)
*G03G 15/00* (2006.01)

(52) U.S. Cl.
CPC ..... *G03G 21/1878* (2013.01); *G03G 15/5004* (2013.01)

(58) Field of Classification Search
CPC ..... G03G 21/1878–1892
See application file for complete search history.

(56) References Cited

U.S. PATENT DOCUMENTS 7,184,682 B2 * 2/2007 Chadani ..... G03G 21/1825 399/111
8,508,770 B2 * 8/2013 Lee ..... G03G 21/1652 358/1.15
8,971,730 B2 * 3/2015 Shibuya ..... G03G 21/1892 399/13

(Continued)

FOREIGN PATENT DOCUMENTS

JP 2008009115 A * 1/2008
JP 2010-128336 A 6/2010

*Primary Examiner* — Clayton E. LaBalle
*Assistant Examiner* — Leon W Rhodes, Jr.
(74) *Attorney, Agent, or Firm* — Burr & Brown, PLLC

(57) ABSTRACT

An image forming apparatus includes a main body, a drum cartridge removably attached to the main body, and a belt unit removably attached to the main body. The main body includes a drum power supply, a belt power supply, and a controller configured to start supplying power from the drum power supply to a drum memory of the drum cartridge, start supplying power from the belt power supply to a belt memory of the belt unit, stop supplying the power from the drum power supply to the drum memory after starting supplying the power from the drum power supply to the drum memory, and stop supplying the power from the belt power supply to the belt memory after starting supplying the power from the belt power supply to the belt memory.

15 Claims, 7 Drawing Sheets

(56) References Cited

U.S. PATENT DOCUMENTS

| | | | | |
|---|---|---|---|---|
| 9,086,679 | B2 * | 7/2015 | Lee | G03G 21/1878 |
| 10,459,363 | B2 * | 10/2019 | Lin | G03G 15/0863 |
| 2010/0135693 | A1 | 6/2010 | Okabe et al. | |
| 2012/0038937 | A1 * | 2/2012 | Son | G03G 15/80 358/1.1 |

* cited by examiner

IMAGE FORMING APPARATUS, METHOD, AND COMPUTER-READABLE MEDIUM FOR PREVENTING FAILURES AND ERRORS IN DRUM MEMORY AND BELT MEMORY DUE TO HOT-SWAPPING

CROSS-REFERENCE TO RELATED APPLICATION

This application claims priority under 35 U.S.C. § 119 from Japanese Patent Application No. 2019-146923 filed on Aug. 9, 2019. The entire subject matter of the application is incorporated herein by reference.

BACKGROUND

Technical Field

Aspects of the present disclosure are related to an image forming apparatus, a method, and a non-transitory computer-readable medium to prevent failures and data writing errors in a drum memory of a drum cartridge and a belt memory of a belt unit due to hot-swapping of the drum cartridge or the belt unit.

Related Art

Heretofore, an electrophotographic image forming apparatus (e.g., a laser printer and an LED printer) has been known. The image forming apparatus has a drum cartridge. The drum cartridge includes a plurality of photoconductive drums. Further, the drum cartridge has a plurality of toner cartridges removably attached thereto. When the toner cartridges are attached to the drum cartridge, a development roller of each toner cartridge comes into contact with a corresponding one of the photoconductive drums of the drum cartridge.

In addition, the image forming apparatus includes a belt unit. The belt unit has a transfer belt. When the belt unit and the drum cartridge are attached to the image forming apparatus, the transfer belt of the belt unit and the photoconductive drums of the drum cartridge come into contact with each other.

SUMMARY

Furthermore, a drum cartridge having a drum memory as a storage medium has been known. The drum memory stores various types of information regarding the drum cartridge. In addition, a belt unit having a belt memory as a storage medium has been known. The belt memory stores various types of information regarding the belt unit.

However, if the drum cartridge is attached or removed (hot-swapping) while a power supply for energizing the drum memory is powered on, a failure of the drum memory and/or an error in writing data into the drum memory might occur. Similarly, if the belt unit is attached or removed (hot-swapping) while a power supply for energizing the belt memory is powered on, a failure of the belt memory and/or an error in writing data into the belt memory might occur.

Aspects of the present disclosure are advantageous to provide one or more improved techniques, for an image forming apparatus including a drum cartridge having a drum memory and a belt unit having a belt memory, which make it possible to prevent failures and data writing errors in the drum memory and the belt memory due to hot-swapping of the drum cartridge or the belt unit.

According to aspects of the present disclosure, an image forming apparatus is provided, which includes a main body, a drum cartridge configured to be removably attached to the main body, the drum cartridge including a photoconductive drum, a drum memory storing information regarding the photoconductive drum, and a drum connector electrically connected with the drum memory, a belt unit configured to be removably attached to the main body, the belt unit including a transfer belt configured to contact the photoconductive drum of the drum cartridge attached to the main body, a belt memory storing information regarding the transfer belt, and a belt connector electrically connected with the belt memory. The main body includes a first connector configured to connect with the drum connector when the drum cartridge is attached to the main body, a second connector configured to connect with the belt connector when the belt unit is attached to the main body, a drum power supply configured to supply power to the drum memory via the first connector and the drum connector when the drum connector is connected with the first connector, a belt power supply configured to supply power to the belt memory via the second connector and the belt connector when the belt connector is connected with the second connector, and a controller. The connector is configured to start supplying power from the drum power supply to the drum memory, start supplying power from the belt power supply to the belt memory, stop supplying the power from the drum power supply to the drum memory after starting supplying the power from the drum power supply to the drum memory, and stop supplying the power from the belt power supply to the belt memory after starting supplying the power from the belt power supply to the belt memory.

According to aspects of the present disclosure, further provided is a method implementable on a controller of an image forming apparatus, the method including starting supplying power from a drum power supply to a drum memory, starting supplying power from a belt power supply to a belt memory, stopping supplying the power from the drum power supply to the drum memory after starting supplying the power from the drum power supply to the drum memory, and stopping supplying the power from the belt power supply to the belt memory after starting supplying the power from the belt power supply to the belt memory. The image forming apparatus includes a main body, a drum cartridge configured to be removably attached to the main body, the drum cartridge including a photoconductive drum, the drum memory storing information regarding the photoconductive drum, and a drum connector electrically connected with the drum memory, a belt unit configured to be removably attached to the main body, the belt unit including a transfer belt configured to contact the photoconductive drum of the drum cartridge attached to the main body, the belt memory storing information regarding the transfer belt, and a belt connector electrically connected with the belt memory. The main body includes the controller, a first connector configured to connect with the drum connector when the drum cartridge is attached to the main body, a second connector configured to connect with the belt connector when the belt unit is attached to the main body, the drum power supply configured to supply the power to the drum memory via the first connector and the drum connector when the drum connector is connected with the first connector, and the belt power supply configured to supply the power to the belt memory via the second connector and the belt connector when the belt connector is connected with the second connector.

According to aspects of the present disclosure, further provided is a non-transitory computer-readable medium storing computer-readable instructions executable by a processor included in a controller of an image forming apparatus. The instructions are configured to, when executed by the processor, cause the controller to start supplying power from a drum power supply to a drum memory, start supplying power from a belt power supply to a belt memory, stop supplying the power from the drum power supply to the drum memory after starting supplying the power from the drum power supply to the drum memory, and stop supplying the power from the belt power supply to the belt memory after starting supplying the power from the belt power supply to the belt memory. The image forming apparatus includes a main body, a drum cartridge configured to be removably attached to the main body, the drum cartridge including a photoconductive drum, the drum memory storing information regarding the photoconductive drum, and a drum connector electrically connected with the drum memory, a belt unit configured to be removably attached to the main body, the belt unit including a transfer belt configured to contact the photoconductive drum of the drum cartridge attached to the main body, the belt memory storing information regarding the transfer belt, and a belt connector electrically connected with the belt memory. The main body includes the controller, a first connector configured to connect with the drum connector when the drum cartridge is attached to the main body, a second connector configured to connect with the belt connector when the belt unit is attached to the main body, the drum power supply configured to supply the power to the drum memory via the first connector and the drum connector when the drum connector is connected with the first connector, and the belt power supply configured to supply the power to the belt memory via the second connector and the belt connector when the belt connector is connected with the second connector.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, illustrative embodiments according to aspects of the present disclosure will be described with reference to the accompanying drawings.

In the following description, a direction in which rotational axes of photoconductive drums extend will be referred to as a "first direction." Further, a direction along which the photoconductive drums are arranged will be referred to as a "second direction." The first direction and the second direction intersect each other (preferably orthogonally).

1. Configuration of Image Forming Apparatus

Figure 1:
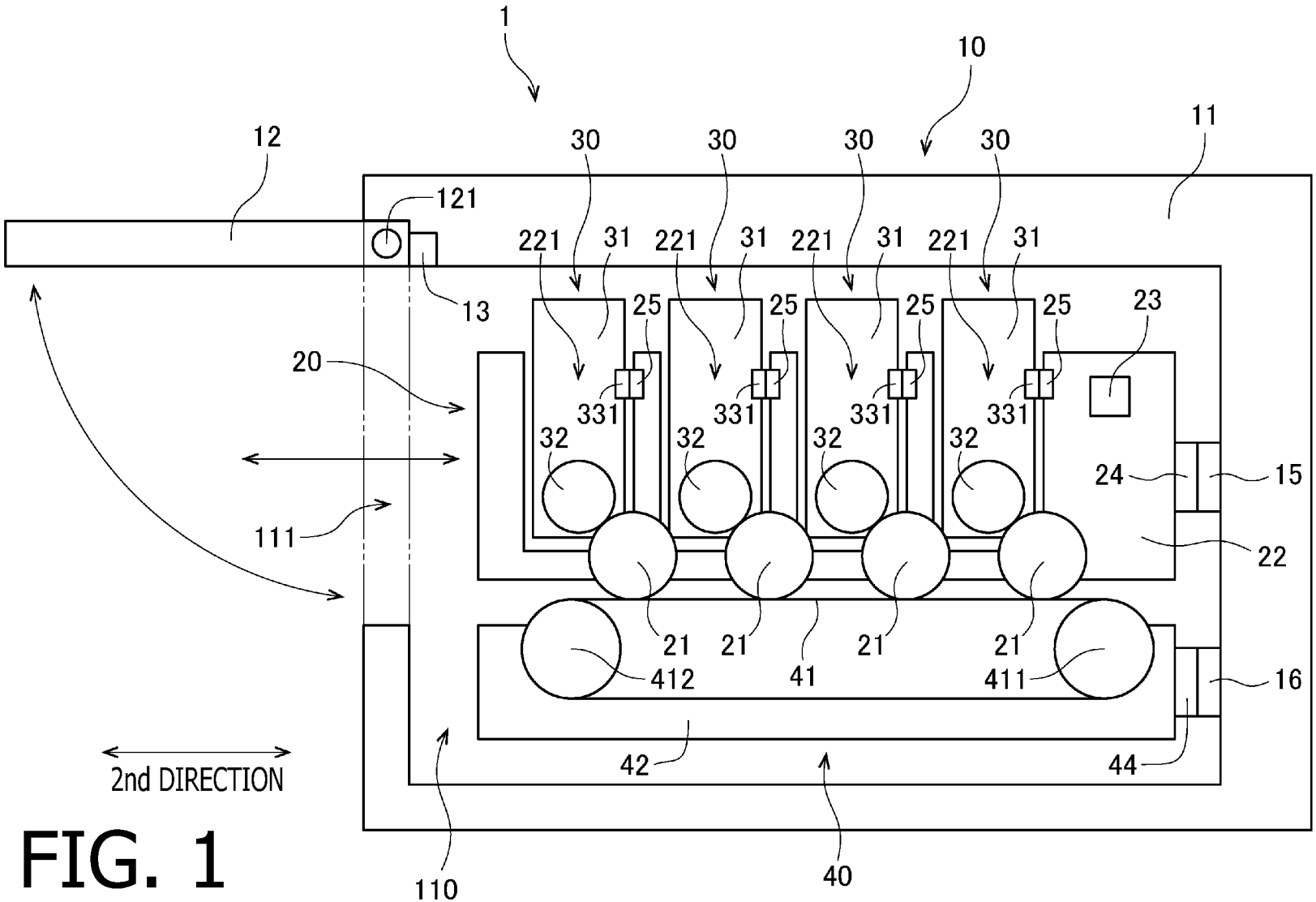
FIG. 1 is a cross-sectional view schematically showing a configuration of an image forming apparatus according to one or more aspects of the present disclosure.
Figure 2:
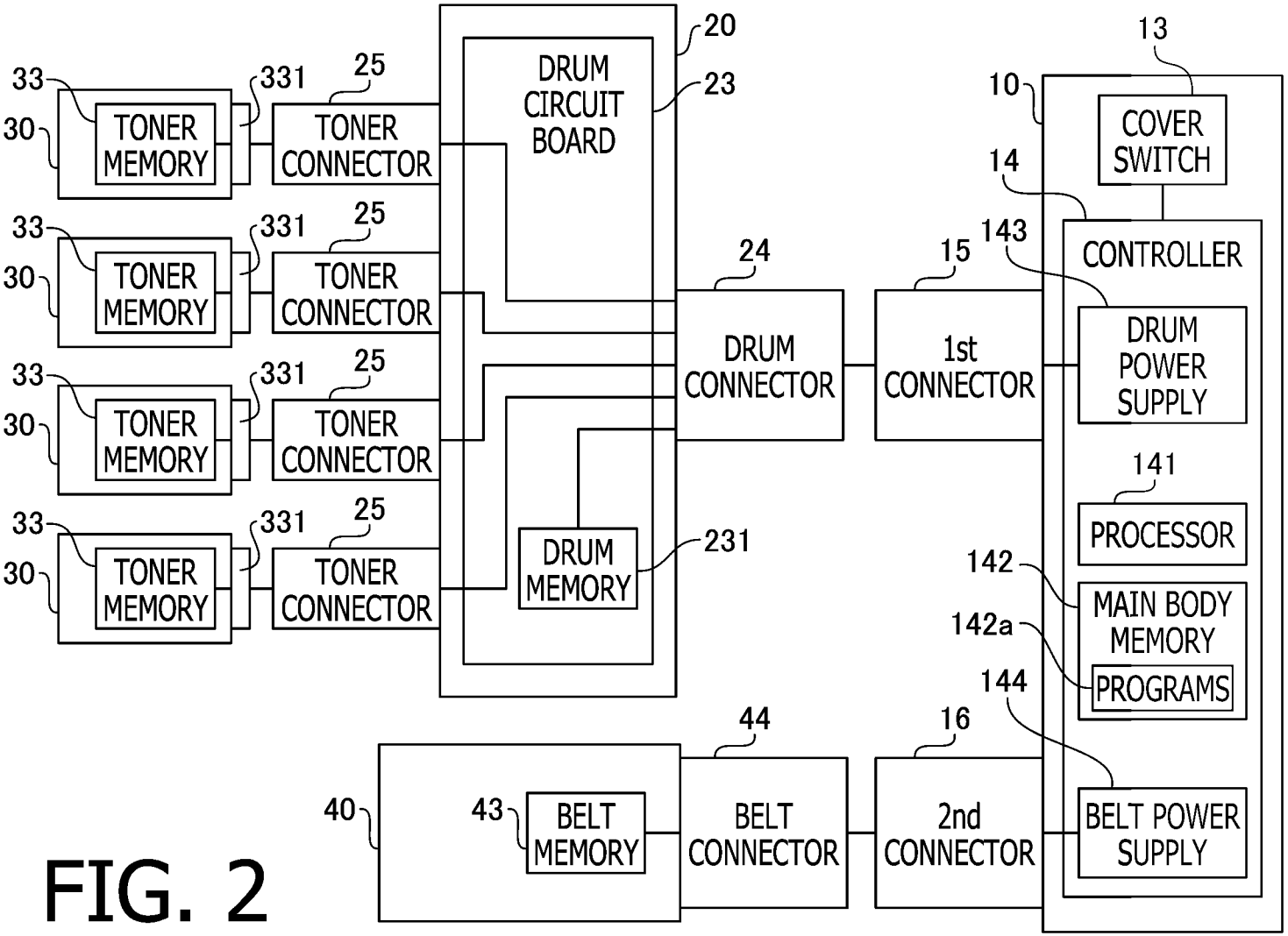
FIG. 2 is a block diagram schematically showing an electrical configuration of the image forming apparatus according to one or more aspects of the present disclosure.

FIG. 1 is a cross-sectional side view of an image forming apparatus 1. FIG. 2 is a block diagram showing an electrical configuration of the image forming apparatus 1. This image forming device 1 is an electrophotographic printer. Examples of the image forming device 1 may include, but are not limited to, a laser printer and an LED printer. As shown in FIGS. 1 and 2, the image forming apparatus 1 includes an apparatus main body 10, a drum cartridge 20, a plurality of toner cartridges 30, and a belt unit 40.

Each of the plurality of toner cartridges 30 is individually attachable to the drum cartridge 20. Further, the drum cartridge 20 with the plurality of toner cartridges 30 attached thereto is configured to be removably attached to the apparatus main body 10. In addition, the belt unit 40 is configured to be removably attached to the apparatus main body 10.

The apparatus main body 10 includes a main body casing 11, a cover 12, a cover switch 13, and a controller 14.

The main body casing 11 has an inner space 110 configured to accommodate the belt unit 40 and the drum cartridge 20. In addition, the main body casing 11 has an opening 111. The cover 12 is movable between an open state (as indicated by a solid line in FIG. 1) in which the opening 111 is opened and a closed state (as indicated by a double-dotted chain line in FIG. 1) in which the opening 111 is closed. Specifically, the cover 12 is rotatable between the open state and the closed state, around a hinge 121 extending in the first direction. When the cover 12 is open, the inner space 110 of the main body casing 11 is communicated with the outside through the opening 111. Thus, the belt unit 40 and the drum cartridge 20 are allowed to be attached and detached via the opening 111. Meanwhile, when the cover 12 is closed, the belt unit 40 and the drum cartridge 20 are unable to be attached or detached.

As described above, the belt unit 40 and the drum cartridge 20 are enabled to be attached to and removed from the main body casing 11 via the opening 111. Further, the belt unit 40 is attached at a position further away from the opening 111 than the drum cartridge 20 is. Therefore, the belt unit 40 is allowed to be attached to the apparatus main body 10 only before the drum cartridge 20 is attached to the apparatus main body 10. Moreover, the belt unit 40 is allowed to be removed from the apparatus main body 10 only after the drum cartridge 20 is removed from the apparatus main body 10.

The cover switch 13 includes a sensor configured to detect whether the cover 12 is in the open state or the closed state. For instance, the cover switch 13 is disposed in a position close to the hinge 121 of the cover 12. The cover switch 13 is electrically connected with the controller 14. The cover switch 13 is configured to output a particular detection signal to the controller 14 when the cover 12 is in the open state or the closed state. Furthermore, the controller 14 may include a control circuit board (not shown).

The controller 14 is located in the main body casing 11. For instance, the controller 14 includes a processor 141 such as a CPU, a main body memory 142 that is a storage medium, a drum power supply 143, and a belt power supply 144. The controller 14 performs various processes to control the image forming apparatus 1 when the processor 141 operates in accordance with programs. For instance, the controller 14 may perform various processes to control the image forming apparatus 1 when the processor 141 executes programs 142*a* stored in the main body memory 142. Further, the apparatus main body 10 includes a first connector 15 and a second connector 16. The first connector 15 and the second connector 16 are electrically connected with the controller 14. The drum power supply 143 is configured to supply electricity to a below-mentioned drum memory 231 via the first connector 15. The belt power supply 144 is configured to supply electricity to a below-mentioned belt memory 43 via the second connector 16.

The drum cartridge 20 includes a plurality of photoconductive drums 21, a drum frame 22, a drum circuit board 23, a drum connector 24, and a plurality of toner connectors 25.

Each photoconductive drum 21 is configured to transfer toner supplied from the corresponding toner cartridge 30 onto a printing sheet. For instance, the number of the photoconductive drums 21 is four. The four photoconductive drums 21 are arranged at intervals along the second direction. Each photoconductive drum 21 has a cylindrical outer circumferential surface extending in the first direction. The outer circumferential surface of each photoconductive drum 21 is covered with photosensitive material. In addition, each photoconductive drum 21 is rotatable around a rotation axis extending in the first direction.

The drum frame 22 has four slots 221. The four slots 221 are arranged at intervals along the second direction. Each toner cartridge 30 is attached to a corresponding one of the slots 221. Accordingly, the four toner cartridges 30 are allowed to be attached to the drum frame 22. However, the number of the toner cartridges 30 attachable to the drum frame 22 may be one to three, or may be four or more. When a toner cartridge 30 is attached to the drum frame 22, a below-mentioned development roller 32 of the toner cartridge 30 comes into contact with the corresponding photoconductive drum 21.

For instance, the drum circuit board 23 is fixed to a surface of the drum frame 22. As shown in FIG. 2, the drum circuit board 23 has a drum memory 231. The drum memory 231 is a storage medium configured such that information is written therein and read therefrom. The drum memory 231 stores therein various types of information regarding the drum cartridge 20. For instance, the drum memory 231 stores information regarding the photoconductive drums 21. Specifically, the drum memory 231 stores at least one of a serial number of the drum cartridge 20, an identification code representing that the drum cartridge 20 is a genuine product, compatible models for the drum cartridge 20, specifications of the drum cartridge 20, a lifetime of each photoconductive drum 21, charging characteristics of each photoconductive drum 21, information representing whether each photoconductive drum 21 is a new one, the number of rotations of each photoconductive drum 21, a charge time of each photoconductive drum 21, the number of sheets printed, and an error history.

It is noted that the drum memory 231 may not be located on the drum circuit board 23. For instance, the drum memory 231 may be disposed at the surface of the drum frame 22, separately from the drum circuit board 23.

The drum connector 24 is a connector electrically connected with the drum circuit board 23. For instance, the drum connector 24 is fixed to the surface of the drum frame 22. However, the drum connector 24 may be slightly movable relative to the drum frame 22. When the drum cartridge 20 is attached to the main body casing 11, the drum connector 24 of the drum cartridge 20 is connected with the first connector 15 of the apparatus main body 10. Thereby, the controller 14 and the drum memory 231 are electrically connected with each other via the first connector 15 and the drum connector 24.

Figure 3:
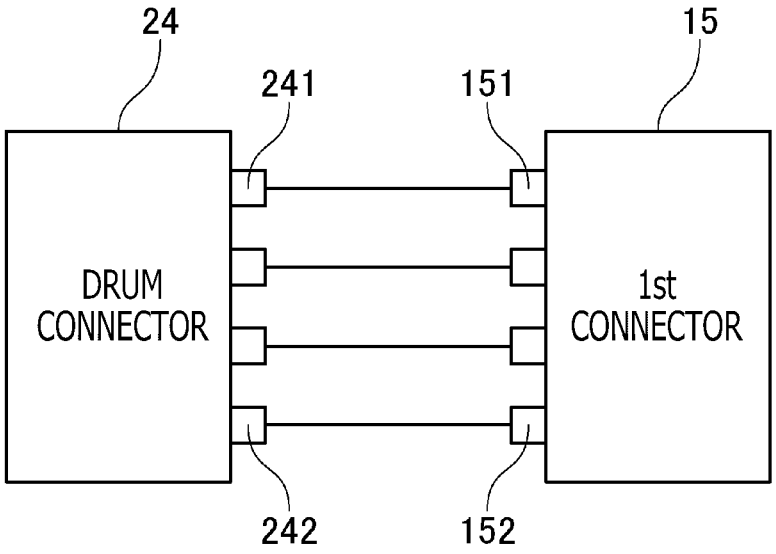
FIG. 3 illustrates an electrical connection between a first connector and a drum connector in the image forming apparatus according to one or more aspects of the present disclosure.

FIG. 3 shows in more detail the connection between the first connector 15 and the drum connector 24. As shown in FIG. 3, the first connector 15 has a plurality of terminals. The plurality of terminals of the first connector 15 include at least one first power terminal 151 and at least one first communication terminal 152. In addition, the drum connector 24 has a plurality of terminals. The plurality of terminals of the drum connector 24 include at least one drum power terminal 241 and at least one drum communication terminal 242. The at least one drum power terminal 241 is connected with the at least one first power terminal 151. The drum power supply 143 supplies electricity to the drum memory 231 via the at least one first power terminal 151 and the at least one drum power terminal 241. The at least one drum communication terminal 242 is connected to the at least one first communication terminal 152. The controller 14 performs data communication with the drum memory 231 via the at least one first communication terminal 152 and the at least one drum communication terminal 242.

Figure 4:
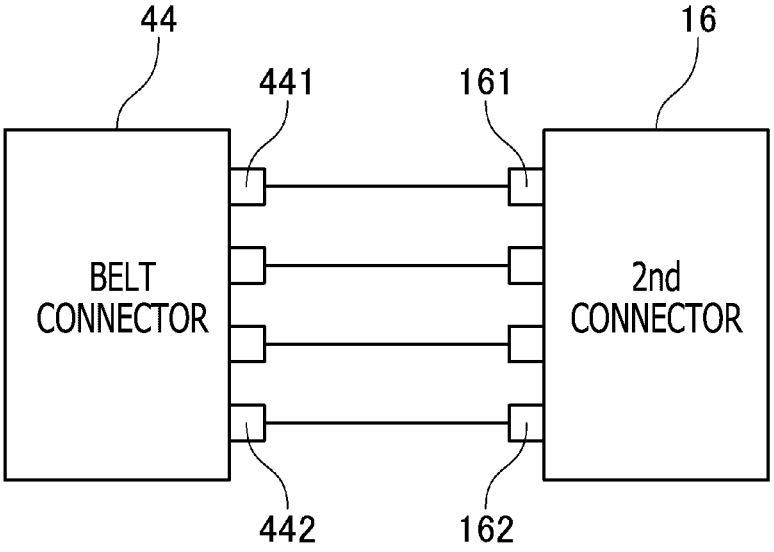
FIG. 4 illustrates an electrical connection between a second connector and a belt connector in the image forming apparatus according to one or more aspects of the present disclosure.

FIG. 4 shows in more detail the connection between the second connector 16 and the belt connector 44. As shown in FIG. 4, the second connector 16 has a plurality of terminals. The plurality of terminals of the second connector 16 include at least one second power terminal 161 and at least one second communication terminal 162. In addition, the belt connector 44 has a plurality of terminals. The plurality of terminals of the belt connector 44 include at least one belt power terminal 441 and at least one belt communication terminal 442. The at least one belt power terminal 441 is connected with the at least one second power terminal 161. The belt power supply 144 supplies electricity to the belt memory 43 via the at least one second power terminal 161 and the at least one belt power terminal 441. The at least one belt communication terminal 442 is connected with the at least one second communication terminal 162. The controller 14 performs data communication with the belt memory 43 via the at least one second communication terminal 162 and the at least one belt communication terminal 442.

Referring back to FIG. 2, the plurality of toner connectors 25 are electrically connected with the drum circuit board 23. A toner connector 25 is provided for each slot 221. Namely, the drum cartridge 20 has four toner connectors 25. For instance, the toner connector 25 is fixed to the surface of the drum frame 22. However, the toner connector 25 may be slightly movable relative to the drum frame 22.

Each toner cartridge 30 includes a casing 31, a development roller 32, and a toner memory 33. The casing 31 is a housing configured to store toner. The development roller 32 is rotatable around a rotation axis extending in the first direction. The development roller 32 is located at an end of the casing 31 in a third direction that intersects the first direction and the second direction. When a toner cartridge 30 is attached to the drum cartridge 20, an outer circumferential surface of the development roller 32 comes into contact with the outer circumferential surface of the corresponding photoconductive drum 21. Toner is supplied from inside the casing 31 to the outer circumferential surface of the photoconductive drum 21 via the development roller 32.

The plurality of toner cartridges 30 are configured to store toner (developer) of respective different colors (e.g., cyan, magenta, yellow, and black). The image forming apparatus 1 forms an image on a printing surface of a printing sheet with toner supplied from the plurality of toner cartridges 30.

Each toner memory 33 is a storage medium configured such that information is written therein and read therefrom. Each toner memory 33 has an electrical contact surface 331. For instance, the electrical contact surface 331 may be located at a surface of a holder (not shown). The holder may be fixed to the casing 31 or may be slightly movable relative to the casing 31. Each toner memory 33 stores therein various types of information regarding the corresponding toner cartridge 30. For instance, each toner memory 33 stores information regarding the toner stored in the corresponding toner cartridge 30. Specifically, each toner memory 33 stores at least one of a manufacturing serial number of the corresponding toner cartridge 30, an identification code representing that the toner cartridge 30 is a genuine product, compatible models for the toner cartridge 30, specifications of the toner cartridge 30, a toner capacity, a lifetime of the development roller 32, information representing whether the development roller is a new one, the number of rotations of the development roller 32, the number of sheets printed, and an error history.

It is noted that each toner memory 33 may not be located on the surface of the corresponding holder. For instance, each toner memory 33 may be located at a surface of the corresponding casing 31.

When the plurality of toner cartridges 30 are attached to the drum cartridge 20, the electrical contact surface 331 of each toner memory 33 comes into contact with the corresponding toner connector 25 of the drum cartridge 20. Thereby, the drum circuit board 23 and each toner memory 33 are electrically connected with each other via the corresponding toner connector 25 and the electrical contact surface 331. When the drum cartridge 20 with the plurality of toner cartridges 30 attached is installed in the apparatus main body 10 of the image forming apparatus 1, the controller 14 and each toner memory 33 are electrically connected with each other via the first connector 15, the drum connector 24, the drum circuit board 23, the corresponding toner connector 25, and the electrical contact surface 331.

The belt unit 40 includes a transfer belt 41, a belt frame 42, a belt memory 43, and a belt connector 44.

The transfer belt 41 is an endless annular belt hung around a driving roller 411 and a driven roller 412. The driving roller 411 and the driven roller 412 are supported by the belt frame 42. When the belt unit 40 and the drum cartridge 20 are installed in the apparatus main body 10, the transfer belt 41 comes into contact with the photoconductive drums 21. While printing is performed, the driving roller 411 is driven to rotate by a driving force from a motor (not shown). Thereby, the transfer belt 41 is rotated. The driven roller 412 rotates in accordance with the rotation of the transfer belt 41. The printing sheet is conveyed between each photoconductive drum 21 and the transfer belt 41. Thus, toner is transferred from the outer circumferential surface of each photoconductive drum 21 onto the printing sheet.

For instance, the belt memory 43 is fixed to the belt frame 42. However, the belt memory 43 may be disposed in some other part of the belt unit 40. The belt memory 43 is a storage medium configured such that information is written therein and read therefrom. The belt memory 43 stores therein various types of information regarding the belt unit 40. For instance, the belt memory 43 stores information regarding the transfer belt 41. Specifically, the belt memory 43 stores at least one of a serial number of the belt unit 40, an identification code representing that the belt unit 40 is a genuine product, compatible models for the belt unit 40, specifications of the belt unit 40, a lifetime of the transfer belt 41, characteristics of the transfer belt 41, information representing whether the transfer belt 41 is a new one, the number of rotations of the transfer belt 41, the number of sheets printed, and an error history.

The belt connector 44 is electrically connected with the belt memory 43. For instance, the belt connector 44 is fixed to a surface of the belt frame 42. However, the belt connector 44 may be slightly movable relative to the belt frame 42. When the belt unit 40 is attached to the main body casing 11, the belt connector 44 of the belt unit 40 is connected with the second connector 16 of the apparatus main body 10. Thus, the controller 14 and the belt memory 43 are electrically connected with each other via the second connector 16 and the belt connector 44.

2. Operations Concerning Power Supply (First Illustrative Embodiment)

Figure 5A:
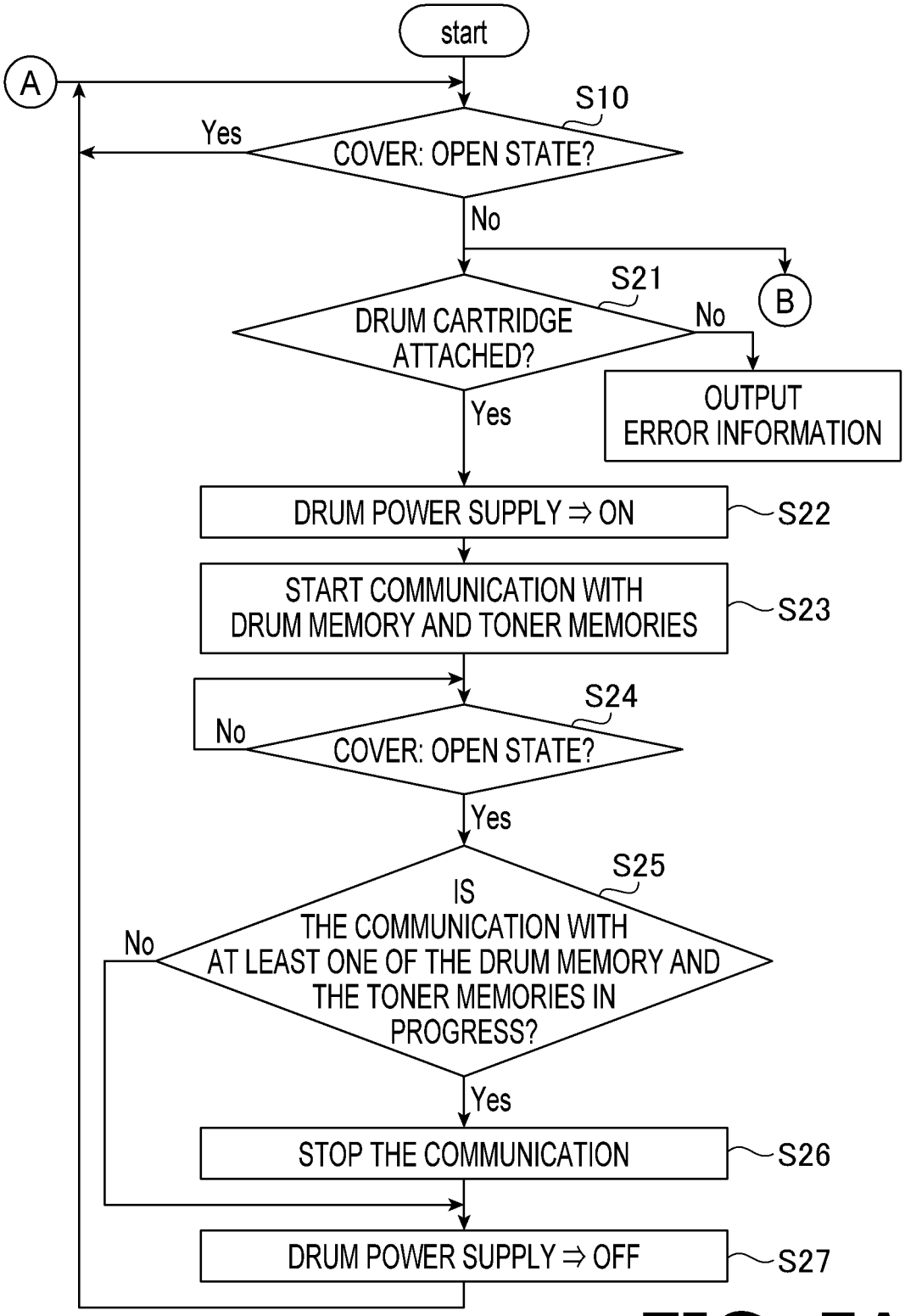
FIGS. 5A and 5B are flowcharts showing a sequence of operations concerning power supply to a drum memory and a belt memory in a first illustrative embodiment according to one or more aspects of the present disclosure.
Figure 5B:
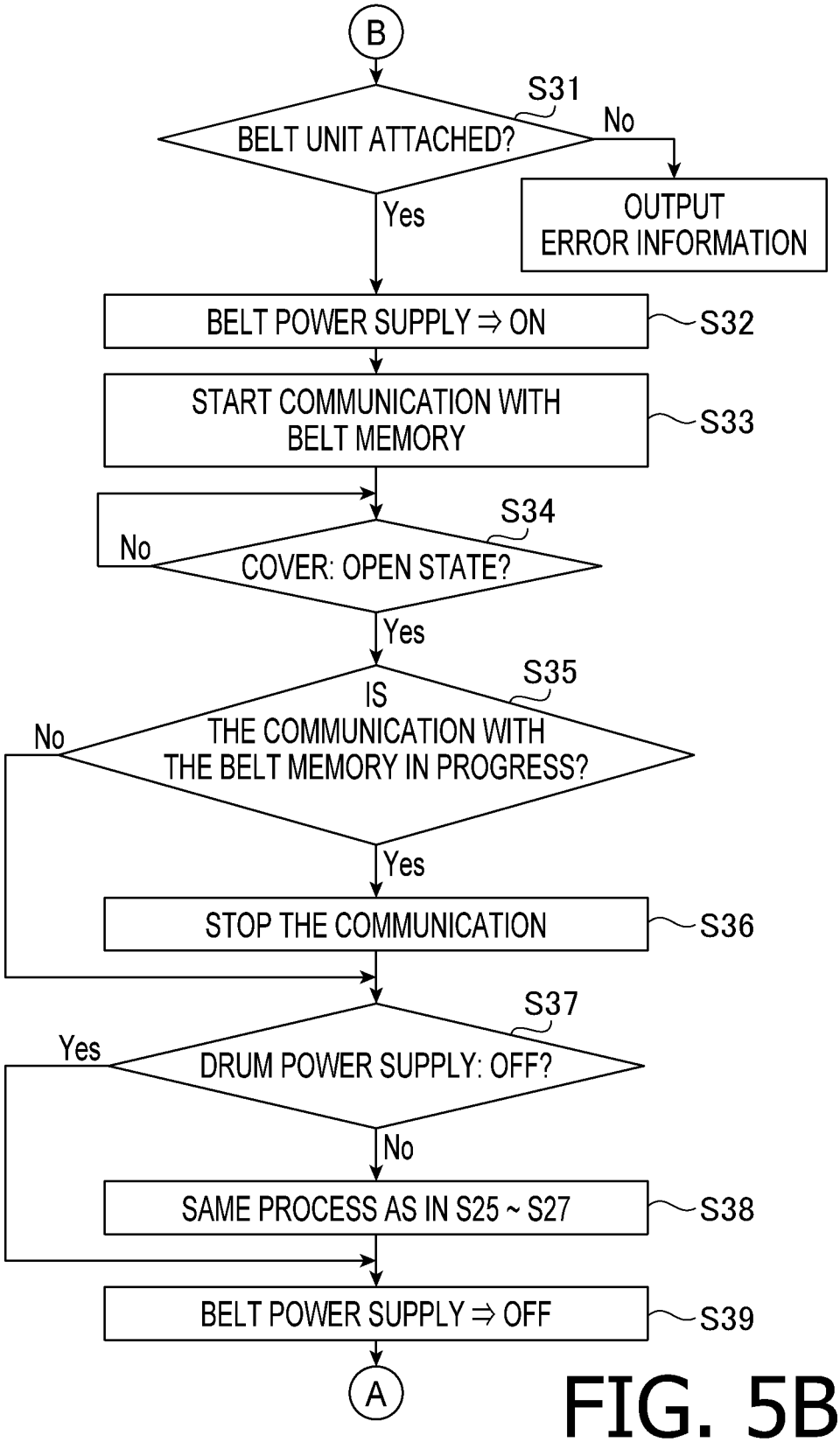

Next, a first illustrative embodiment of operations concerning power supply to the drum memory 231 and the belt memory 43 will be described. FIGS. 5A and 5B are flowcharts showing a sequence of operations by the controller 14 of the image forming apparatus 1 in the first illustrative embodiment. The process shown in FIGS. 5A and 5B may be (at least partially) performed by the processor 141 executing one or more programs 142*a* stored in the main body memory 142 or by the control circuit board of the controller 14. In an initial state of FIG. 5A, a main power supply of the image forming apparatus 1 is powered ON, and both of the drum power supply 143 and the belt power supply 144 are powered OFF.

First, the controller 14 of the image forming apparatus 1 determines whether the cover 12 of the apparatus main body 10 is open (S10, Cover Detecting Step). Specifically, the controller 14 determines whether the detection signal output from the cover switch 13 is a signal indicating the open state. When determining that the cover 12 is open (S10: Yes), the controller 14 repeatedly makes the determination in S10 until the controller 14 determines that the cover 12 is closed.

When determining that the cover 12 is closed (S10: No), the controller 14 performs a process concerning energizing the drum memory 231 (S21 to S27, Drum Energizing Sequence) and a process concerning energizing the belt memory 43 (S31 to S39, Belt Energizing Sequence).

In the drum energizing sequence, the controller 14 first determines whether the drum cartridge 20 is attached to the apparatus main body 10 (S21, Drum Detecting Step). Specifically, for instance, the controller 14 may determine whether the drum connector 24 of the drum cartridge 20 is connected with the first connector 15 of the apparatus main body 10, based on whether there is electrical continuity therebetween. In another instance, the controller 14 may determine whether the drum cartridge 20 is attached to the apparatus main body 10, based on a detection signal from a sensor such as an optical sensor or a switch sensor.

When determining that the drum cartridge 20 is not attached to the apparatus main body 10 (S21: No), the controller 14 outputs error information representing that the drum cartridge 20 is not attached to the apparatus main body 10. For instance, the controller 14 causes a display (not shown) to display a message representing that the drum cartridge 20 is not attached. Meanwhile, when determining that the drum cartridge 20 is attached to the apparatus main body 10 (S21: Yes), the controller 14 switches the drum power supply 143 from OFF to ON (S22, Drum Power Supply Start Step). In other words, the controller 14 starts supplying electricity from the drum power supply 143 to the at least one first power terminal 151. Thereby, electric power begins to be supplied from the drum power supply 143 to the drum memory 231 via the first connector 15 and the drum connector 24. In addition, electric power begins to be supplied from the drum power supply 143 to the toner memories 33 via the first connector 15, the drum connector 24, the drum circuit board 23, the toner connectors 25, and the electrical contact surfaces 331.

When electric power is supplied to the drum memory 231 and the toner memories 33, the controller 14 subsequently starts communication with the drum memory 231 (S23, Drum Communication Start Step). Specifically, the controller 14 performs at least one of data transmission to and data reception from the drum memory 231. Further, the controller 14 starts communication with the toner memories 33. Specifically, the control portion 14 performs at least one of data transmission to and data reception from the toner memories 33.

Thereafter, the controller 14 determines whether the cover 12 of the apparatus main body 10 is brought from the closed state into the open state (S24, Cover Detecting Step). Here, in the same manner as in S10, the controller 14 determines whether the detection signal output from the cover switch 13 is a signal indicating the open state. When determining that the cover 12 is not open (S24: No), the controller 14 continues to make the determination in S24. During the time, the controller 14 may continue the communication with the drum memory 231 and the toner memories 33.

On the other hand, when determining that the cover 12 is opened (S24: Yes), the controller 14 determines whether the communication with at least one of the drum memory 231 and the four toner memories 33 is in progress (S25). Specifically, the controller 14 determines whether at least one of data transmission to the drum memory 231, data reception from the drum memory 231, individual data transmissions to the toner memories 33, and individual data receptions from the toner memories 33 is in execution.

When determining that the communication with at least one of the drum memory 231 and the four toner memories 33 is in progress (S25: Yes), the controller 14 immediately stops the communication (S26, Drum Communication Stop Step). Then, the controller 14 switches the drum power supply 143 from ON to OFF (S27, Drum Power Supply Stop Step). Namely, the controller 14 stops the power supply from the drum power supply 143 to the at least one first power terminal 151. Thus, the power supply from the drum power supply 143 to the drum memory 231 and the toner memories 33 is stopped.

Meanwhile, when determining in S25 that the communication with any of the drum memory 231 and the four toner memories 33 is not in progress (S25: No), the controller 14 switches the drum power supply 143 from ON to OFF without executing S26 (S27, Drum Power Supply Stop Step). Namely, the controller 14 stops the power supply from the drum power supply 143 to the at least one first power terminal 151. Thus, the power supply from the drum power supply 143 to the drum memory 231 and the toner memories 33 is stopped.

In the belt energizing sequence, the controller 14 first determines whether the belt unit 40 is attached to the apparatus main body 10 (S31, Belt Detecting Step). Specifically, for instance, the controller 14 may determine whether the belt unit 40 is attached to the apparatus main body 10, based on a signal output from a sensor (not shown). In this case, the sensor may be an optical sensor for detecting marks formed on an outer surface of the belt frame 42. In another instance, the controller 14 may determine whether the belt unit 40 is attached to the apparatus main body 10, based on whether the belt connector 44 of the belt unit 40 is connected with the second connector 16 of the apparatus main body 10.

When determining that the belt unit 40 is not attached to the apparatus main body 10 (S31: No), the controller 14 outputs error information representing that the belt unit 40 is not attached to the apparatus main body 10. For instance, the controller 14 causes the display (not shown) to display a message representing that the belt unit 40 is not attached. Meanwhile, when determining that the belt unit 40 is attached to the apparatus main body 10 (S31: Yes), the controller 14 switches the belt power supply 144 from OFF to ON (S32, Belt Power Supply Start Step). Namely, the controller 14 starts supplying electricity from the belt power supply 144 to the at least one second power terminal 161. Thus, electric power begins to be supplied from the belt power supply 144 to the belt memory 43 via the second connector 16 and the belt connector 44.

Next, when electric power is supplied to the belt memory 43, the controller 14 starts communication with the belt memory 43 (S33, Belt Communication Start Step). Specifically, the controller 14 performs at least one of data transmission to and data reception from the belt memory 43.

Thereafter, the controller 14 determines whether the cover 12 of the apparatus main body 10 has been brought from the closed state to the open state (S34). Here, in the same manner as in S10, the controller 14 determines whether the detection signal output from the cover switch 13 is a signal indicating the open state. When determining that the cover 12 is not open (S34: No), the controller 14 continues to make the determination in S34. During the time, the controller 14 may continue the communication with the belt memory 43.

On the other hand, when determining that the cover 12 is opened (S34: Yes), the controller 14 determines whether the communication with the belt memory 43 is in progress (S35). Specifically, the controller 14 determines whether at least one of data transmission to the belt memory 43 and data reception from the belt memory 43 is in execution.

When determining that the communication with the belt memory 43 is in progress (S35: Yes), the controller 14 immediately stops the communication (S36, Belt Communication Stop Step). Then, after S36 or when the controller 14 determines that the communication with the belt memory 43 is not in progress (S35: No), the controller 14 determines whether the drum power supply 143 is powered OFF (S37).

When determining that the drum power supply 143 is not powered OFF (S37: No), the controller 14 switches the drum power supply 143 from ON to OFF by executing substantially the same process as in the aforementioned steps S25 to S27 (S38, Drum Power Supply Stop Step). Namely, the controller 14 stops the power supply from the drum power supply 143 to the at least one first power terminal 151.

Thereby, the power supply from the drum power supply 143 to the drum memory 231 and the toner memories 33 is stopped. Thereafter, the controller 14 switches the belt power supply 144 from ON to OFF (S39, Belt Power Supply Stop Step). In other words, the controller 14 stops the power supply from the belt power supply 144 to the at least one second power terminal 161. Thus, the power supply from the belt power supply 144 to the belt memory 43 is stopped.

Meanwhile, when determining in S37 that the drum power supply 143 is powered OFF (S37: Yes), the controller 14 switches the belt power supply 144 from ON to OFF without executing S38 (S39, Belt Power Supply Stop Step). Namely, the controller 14 stops the power supply from the belt power supply 144 to the at least one second power terminal 161. Thus, the power supply from the belt power supply 144 to the belt memory 43 is stopped.

As described above, in the image forming apparatus 1, the controller 14 switches the drum power supply 143 from OFF to ON (S22), and thereafter switches the drum power supply 143 from ON to OFF (S27). In other words, after beginning to supply power to the drum memory 231, the controller 14 stops supplying power to the drum memory 231. Thereby, it is possible to prevent failures of the drum memory 231 and errors in writing data into the drum memory 231 due to hot-swapping of the drum cartridge 20.

Further, the controller 14 switches the belt power supply 144 from OFF to ON (S32), and thereafter switches the belt power supply 144 from ON to OFF (S39). In other words, after beginning to supply power to the belt memory 43, the controller 14 stops supplying power to the belt memory 43. Thereby, it is possible to prevent failures of the belt memory 43 and errors in writing data into the belt memory 43 due to hot-swapping of the belt unit 40.

Moreover, in the image forming apparatus 1, the drum cartridge 20 may be removed immediately after the cover 12 of the apparatus main body 10 is opened. Meanwhile, the belt unit 40 is unable to be removed until the drum cartridge 20 is removed. Therefore, as described above, the controller 14 of the image forming apparatus 1 turns off the drum power supply 143 prior to turning off the belt power supply 144. Thereby, the controller 14 preferentially stops supplying power to the drum memory 231 of the drum cartridge 20 which may be removed immediately, and also preferentially stops supplying power to the toner memories 33 of the toner cartridges 30 attached to the drum cartridge 20. Thus, it is possible to prevent the drum cartridge 30 from being removed while electric power is being supplied to the drum memory 231 and the toner memories 33.

In addition, the controller 14 stops the power supply to the drum memory 231 and the toner memories 33 by turning off the drum power supply 143, and thereafter stops the power supply to the belt memory 43 by turning off the belt power supply 144. Thus, it is possible to make longer a time for the communication between the controller 14 and the belt memory 43 than a time for the communication of the controller 14 with the drum memory 231 and the toner memories 33.

3. Operations Concerning Power Supply (Second Illustrative Embodiment)

Next, a second illustrative embodiment of operations concerning power supply to the drum memory 231 and the belt memory 43 will be described. In the second illustrative embodiment, timings to switch the drum power supply 143 and the belt power supply 144 from OFF to ON are different from those in the aforementioned first embodiment.

Figure 6A:
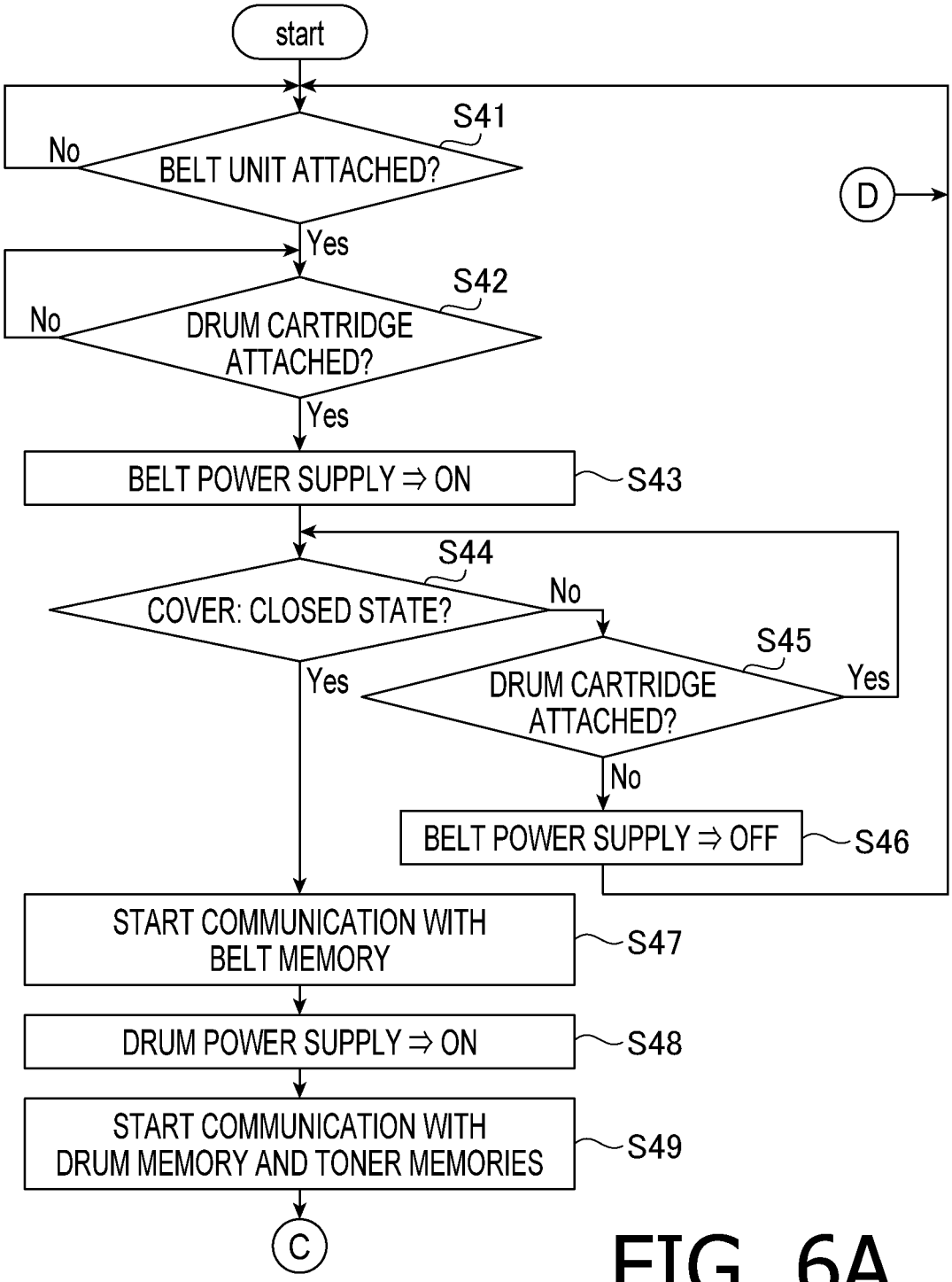
FIGS. 6A and 6B are flowcharts showing a sequence of operations concerning power supply to the drum memory and the belt memory in a second illustrative embodiment according to one or more aspects of the present disclosure.
Figure 6B:
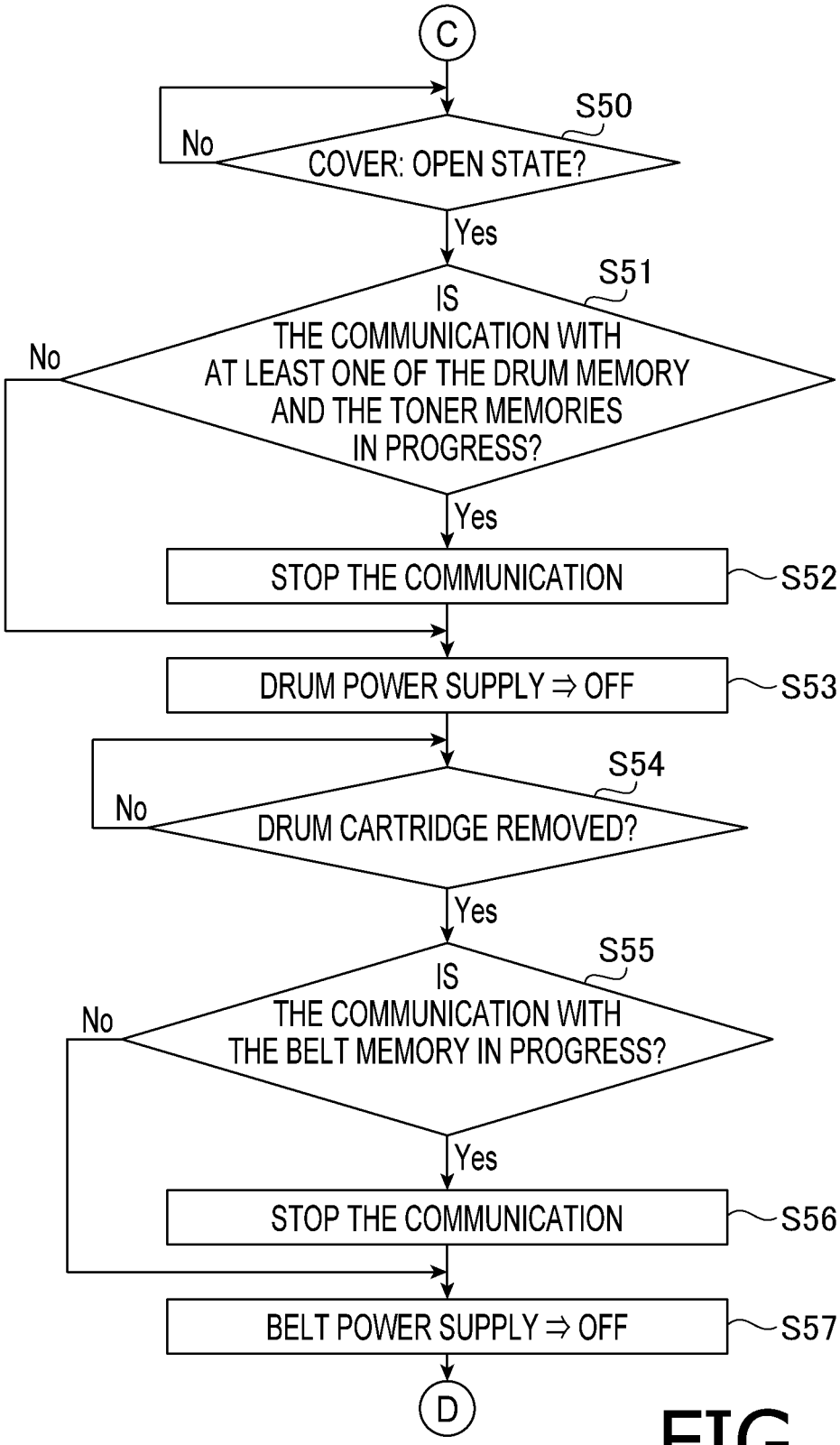

FIGS. 6A and 6B are flowcharts showing a sequence of operations by the controller 14 of the image forming apparatus 1 in the second illustrative embodiment. The process shown in FIGS. 6A and 6B may be (at least partially) performed by the processor 141 executing one or more programs 142*a* stored in the main body memory 142 or by the control circuit board of the controller 14. In an initial state of FIG. 6A, the main power supply of the image forming apparatus 1 is powered ON, and the drum power supply 143 and the belt power supply 144 are powered OFF.

First, the controller 14 of the image forming apparatus 1 determines whether the belt unit 40 is attached to the apparatus main body 10 (S41, Belt Detecting Step). Specifically, for instance, the controller 14 may determine whether the belt unit 40 is attached to the apparatus main body 10, based on a signal output from a sensor (not shown). In this case, the sensor may be an optical sensor for detecting marks formed on the outer surface of the belt frame 42. In another instance, the controller 14 may determine whether the belt unit 40 is attached to the apparatus main body 10, based on whether the belt connector 44 of the belt unit 40 is connected with the second connector 16 of the apparatus main body 10.

When determining that the belt unit 40 is not attached to the apparatus main body 10 (S41: No), the controller 14 repeatedly makes the determination in S41.

Meanwhile, when determining that the belt unit 40 is attached to the apparatus main body 10 (S41: Yes), the controller 14 determines whether the drum cartridge 20 is attached to the apparatus main body 10 (S42, Drum Detecting Step). Specifically, for instance, the controller 14 may determine whether the drum connector 24 of the drum cartridge 20 is connected with the first connector 15 of the apparatus main body 10, based on whether there is electrical continuity therebetween. In another instance, the controller 14 may determine whether the drum cartridge 20 is attached to the apparatus main body 10, based on a detection signal output from a sensor such as an optical sensor or a switch sensor.

When determining that the drum cartridge 20 is not attached to the apparatus main body 10 (S42: No), the controller 14 repeatedly makes the determination in S42.

Meanwhile, when determining that the drum cartridge 20 is attached to the apparatus main body 10 (S42: Yes), the controller 14 switches the belt power supply 144 from OFF to ON (S43, Belt Power Supply Start Step). Namely, the controller 14 starts supplying electricity from the belt power supply 144 to the at least one second power terminal 161. Thus, electric power begins to be supplied from the belt power supply 144 to the belt memory 43 via the second connector 16 and the belt connector 44.

Next, the controller 14 determines whether the cover 12 of the apparatus main body 10 of the apparatus is in the closed state (S44, Cover Detecting Step). Specifically, the controller 14 determines whether the detection signal output from the cover switch 13 is a signal indicating the closed state. When determining that the cover 12 is not closed (S44: No), the controller 14 checks again whether the drum cartridge 20 is attached to the apparatus main body 10 (S45). Then, when confirming that the drum cartridge 20 is attached to the apparatus main body 10 (S45: Yes), the controller 14 continues to make the determination in S44.

Meanwhile, when determining in S45 that the drum cartridge 20 is not attached to the apparatus main body 10 (S45: No), the controller 14 switches the belt power supply 144 from ON to OFF (S46, Belt Power Supply Stop Step). Namely, the controller 14 stops the power supply from the belt power supply 144 to the at least one second power terminal 161. Thereby, the power supply from the belt power supply 144 to the belt memory 43 is stopped. Thereafter, the controller 14 goes back to S41.

When determining in S44 that the cover 12 is closed (S44: Yes), the controller 14 starts communication with the belt memory 43 (S47, Belt Communication Start Step). Specifically, the controller 14 performs at least one of data transmission to and data reception from the belt memory 43.

Subsequently, the controller 14 switches the drum power supply 143 from OFF to ON (S48, Drum Power Supply Start Step). Namely, the controller 14 starts supplying electricity from the drum power supply 143 to the at least one first power terminal 151. Thereby, electric power begins to be supplied from the drum power supply 143 to the drum memory 231 via the first connector 15 and the drum connector 24. In addition, electric power begins to be supplied from the drum power supply 143 to the toner memories 33 via the first connector 15, the drum connector 24, the drum circuit board 23, the toner connectors 25, and the electrical contact surfaces 331.

When electric power is supplied to the drum memory 231 and the toner memory 33, subsequently, the controller 14 starts communication with the drum memory 231 (S49, Drum Communication Start Step). Specifically, the controller 14 performs at least one of data transmission to and data reception from the drum memory 231. Further, the controller 14 starts communication with the toner memories 33. Specifically, the controller 14 performs at least one of data transmission to and data reception from the toner memories 33.

Thereafter, the controller 14 determines whether the cover 12 of the apparatus main body 10 is brought from the closed state to the open state (S50, Cover Detecting Step). Here, the controller 14 determines whether the detection signal output from the cover switch 13 is a signal indicating the open state. When determining that the cover 12 is not open (S50: No), the controller 14 continues to make the determination in S50. During the time, the controller 14 may continue the communication with the drum memory 231 and with the belt memory 43.

Meanwhile, when determining that the cover 12 has been opened (S50: Yes), the controller 14 determines whether the communication with at least one of the drum memory 231 and the four toner memories 33 is in progress (S51). Specifically, the controller 14 determines whether at least one of data transmission to the drum memory 231, data reception from the drum memory 231, data transmission to at least one of the toner memories 33, and data reception from at least one of the toner memories 33 is in execution.

When determining that the communication with at least one of the drum memory 231 and the four toner memories 33 is in progress (S51: Yes), the controller 14 immediately stops the communication (S52, Drum Communication Stop Step). Then, the controller 14 switches the drum power supply 143 from ON to OFF (S53, Drum Power Supply Stop Step). Namely, the controller 14 stops the power supply from the drum power supply 143 to the at least one first power terminal 151. Thus, the power supply from the drum power supply 143 to the drum memory 231 and the toner memories 33 is stopped.

On the other hand, when determining that the communication with at least one of the drum memory 231 and the four toner memories 33 is not in progress (S51: No), the controller 14 switches the drum power supply 143 from ON to OFF without executing S52 (S53, Drum Power Supply Stop Step). Namely, the controller 14 stops the power supply from the drum power supply 143 to the at least one first power terminal 151. Thereby, the power supply from the drum power supply 143 to the drum memory 231 and the toner memories 33 is stopped.

Subsequently, the controller 14 determines whether the drum cartridge 20 has been removed from the apparatus main body 10 (S54). Specifically, for instance, the controller 14 may determine whether the drum connector 24 of the drum cartridge 20 has been disconnected from the first connector 15 of the apparatus main body 10, based on whether there is electrical continuity therebetween. In another instance, the controller 14 may determine whether the drum cartridge 20 has been removed from the apparatus main body 10, based on a detection signal output from a sensor such as an optical sensor or a switch sensor.

When determining that the drum cartridge 20 is not removed from the apparatus main body 10 (S54: No), the controller 14 repeatedly makes the determination in S54. During the time, the controller 14 may continue the communication with the belt memory 43.

Meanwhile, when determining that the drum cartridge 20 is removed from the apparatus main body 10 (S54: Yes), the controller 14 determines whether the communication with the belt memory 43 is in progress (S55). Specifically, the controller 14 determines whether at least one of data transmission to and data reception from the belt memory 43 is in execution.

When determining that the communication with the belt memory 43 is in progress (S55: Yes), the controller 14 immediately stops the communication (S56, Belt Communication Stop Step). Then, the controller 14 switches the belt power supply 144 from ON to OFF (S57, Belt Power Supply Stop Step). Namely, the controller 14 stops the power supply from the belt power supply 144 to the at least one second power terminal 161. Thus, the power supply from the belt power supply 144 to the belt memory 43 is stopped.

On the other hand, when determining in S55 that the communication with the belt memory 43 is not in progress (S55: No), the controller 14 switches the belt power supply 144 from ON to OFF without executing S56 (S57, Belt Power Supply Stop Step). Namely, the controller 14 stops the power supply from the belt power supply 144 to the at least one second power terminal 161. Thereby, the power supply from the belt power supply 144 to the belt memory 43 is stopped.

As described above, in the image forming apparatus 1, the controller 14 switches the drum power supply 143 from OFF to ON (S48), and thereafter switches the drum power supply 143 from ON to OFF (S53). In other words, after beginning to supply power to the drum memory 231, the controller 14 stops supplying power to the drum memory 231. Thereby, it is possible to prevent failures of the drum memory 231 and errors in writing data into the drum memory 231 due to hot-swapping of the drum cartridge 20.

Further, the controller 14 switches the belt power supply 144 from OFF to ON (S43), and thereafter switches the belt power supply 144 from ON to OFF (S57). In other words, after beginning to supply power to the belt memory 43, the controller 14 stops supplying power to the belt memory 43. Thereby, it is possible to prevent failures of the belt memory 43 and errors in writing data into the belt memory 43 due to hot-swapping of the belt unit 40.

Further, in the image forming apparatus 1, the belt unit 40 is first attached to the apparatus main body 10, and the drum cartridge 20 is subsequently attached to the apparatus main body 10. Therefore, as described above, in the second illustrative embodiment, the controller 14 of the image forming apparatus 1 turns on the belt power supply 144 prior to turning on the drum power supply 143. Thereby, the controller 14 preferentially starts supplying power to the belt memory 43 of the belt unit 40 first attached. Thus, it is possible to make longer the time for the communication between the controller 14 and the belt memory 43.

Further, in the second illustrative embodiment, the controller 14 turns off the drum power supply 143 prior to turning off the belt power supply 144. Thereby, the controller 14 preferentially stops supplying power to the drum memory 231 of the drum cartridge 20 which may be removed immediately after the cover 12 is opened, and also preferentially stops supplying power to the toner memories 33 of the toner cartridges 30 attached to the drum cartridge 20. Thus, it is possible to prevent the drum cartridge 30 from being removed while electric power is being supplied to the drum memory 231 and the toner memories 33.

Further, the controller 14 turns off the drum power supply 143 to stop supplying power to the drum memory 231 and the toner memories 33, and thereafter turns off the belt power supply 144 to stop supplying power to the belt memory 43. Thus, it is possible to make longer the time for the communication between the controller 14 and the belt memory 43 than the time for the communication of the controller 14 with the drum memory 231 and the toner memories 33.

Hereinabove, the illustrative embodiments according to aspects of the present disclosure have been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

4. Modifications

In the aforementioned illustrative embodiments, the cover switch 13 is configured to detect whether the cover 12 is in the open state or the closed state. However, the cover switch 13 may be configured to detect a rotation angle of the cover 12 with finer accuracy. In this case, even if the opening 111 is not completely closed, a state where the cover 12 is at such a rotation angle that the drum cartridge 20 is substantially unable to be removed from the apparatus main body 10 may be treated as the "closed state."

Further, the period during which the drum power supply 143 is powered ON and the period during which the belt power supply 144 is powered ON may not overlap. In other words, the controller 14 may not supply power from the belt power supply 144 to the belt memory 43 while power is supplied from the drum power supply 143 to the drum memory 231, and may not supply power from the drum power supply 143 to the drum memory 231 while power is supplied from the belt power supply 144 to the belt memory 43.

In this case, the controller 14 may supply power from the drum power supply 143 to the drum memory 231 when determining that the cover 12 is closed and that the drum cartridge 20 is attached to the apparatus main body 10. Further, the controller 14 may supply power from the belt power supply 144 to the belt memory 43 when determining that the cover 12 is open and that the drum cartridge 20 and the belt unit 40 are attached to the apparatus main body 10.

The following shows examples of associations between elements exemplified in the aforementioned illustrative embodiment and modifications and elements according to aspects of the present disclosure. The image forming apparatus 1 may be an example of an "image forming apparatus" according to aspects of the present disclosure. The apparatus main body 10 may be an example of a "main body" according to aspects of the present disclosure. The drum cartridge 20 may be an example of a "drum cartridge" according to aspects of the present disclosure. Each photoconductive drum 21 may be an example of a "photoconductive drum" according to aspects of the present disclosure. The drum memory 231 may be an example of a "drum memory" according to aspects of the present disclosure. The drum connector 24 may be an example of a "drum cartridge" according to aspects of the present disclosure. The belt unit 40 may be an example of a "belt unit" according to aspects of the present disclosure. The transfer belt 41 may be an example of a "transfer belt" according to aspects of the present disclosure. The belt memory 43 may be an example of a "belt memory" according to aspects of the present disclosure. The belt connector 44 may be an example of a "belt connector" according to aspects of the present disclosure. The first connector 15 may be an example of a "first connector" according to aspects of the present disclosure. The second connector 16 may be an example of a "second connector" according to aspects of the present disclosure. The drum power supply 143 may be an example of a "drum power supply" according to aspects of the present disclosure. The belt power supply 144 may be an example of a "belt power supply" according to aspects of the present disclosure. The controller 14 may be an example of a "controller" according to aspects of the present disclosure. The cover 12 may be an example of a "cover" according to aspects of the present disclosure. Each toner cartridge 30 may be included in examples of "one or more toner cartridges" according to aspects of the present disclosure. Each toner connector 25 may be included in examples of "one or more toner connectors" according to aspects of the present disclosure. The drum circuit board 20 may be an example of a "drum circuit board" according to aspects of the present disclosure. The processor 141 may be an example of a "processor" according to aspects of the present disclosure. The main body memory 142 may be an example of a "non-transitory computer-readable medium" according to aspects of the present disclosure. The programs 142*a* may be included in examples of "computer-readable instructions" according to aspects of the present disclosure.

What is claimed is:

1. An image forming apparatus comprising:

a main body;

a drum cartridge configured to be removably attached to the main body, the drum cartridge comprising a photoconductive drum;

a drum memory storing information regarding the photoconductive drum, and a drum connector electrically connected with the drum memory;

a belt unit configured to be removably attached to the main body, the belt unit comprising a transfer belt configured to contact the photoconductive drum of the drum cartridge attached to the main body, a belt memory storing information regarding the transfer belt, and a belt connector electrically connected with the belt memory, wherein the main body comprises a first connector configured to connect with the drum connector when the drum cartridge is attached to the main body, a second connector configured to connect with the belt connector when the belt unit is attached to the main body, a drum power supply configured to supply power to the drum memory via the first connector and the drum connector when the drum connector is connected with the first connector, a belt power supply configured to supply power to the belt memory via the second connector and the belt connector when the belt connector is connected with the second connector, a cover configured to move between an open state, where an opening is opened, the opening being configured such that the drum cartridge is attached to and removed from the main body therethrough, and a closed state, where the opening is closed, and a controller configured to start supplying power from the drum power supply to the drum memory, start supplying power from the belt power supply to the belt memory, stop supplying the power from the drum power supply to the drum memory after starting supplying the power from the drum power supply to the drum memory, and stop supplying the power from the belt power supply to the belt memory after stopping supplying the power from the drum power supply to the drum memory when the cover is moved from the closed state to the open state when the controller is supplying the power from the drum power supply to the drum memory and is supplying the power from the belt power supply to the belt memory.

2. The image forming apparatus according to claim 1, wherein the controller is further configured to:

start communication with the drum memory after starting supplying the power from the drum power supply to the drum memory;

stop the communication with the drum memory after starting the communication with the drum memory; and stop supplying the power from the drum power supply to the drum memory after stopping the communication with the drum memory.

3. The image forming apparatus according to claim 2, wherein the controller is further configured to:

determine whether the communication with the drum memory is in progress, before stopping supplying the power from the drum power supply to the drum memory; and when determining that the communication with the drum memory is in progress, immediately stop the communication with the drum memory.

4. The image forming apparatus according to claim 1, wherein the controller is further configured to:

detect whether the cover is in the open state or the closed state, in a state where the drum cartridge and the belt unit are attached to the main body; and when detecting that the cover is in the open state, stop supplying the power from the drum power supply to the drum memory.

5. The image forming apparatus according to claim 1, wherein the controller is further configured to:

start communication with the belt memory after starting supplying the power from the belt power supply to the belt memory;

stop the communication with the belt memory after starting the communication with the belt memory; and stop supplying the power from the belt power supply to the belt memory after stopping the communication with the belt memory.

6. The image forming apparatus according to claim 5, wherein the controller is further configured to:

determine whether the communication with the belt memory is in progress, before stopping supplying the power from the belt power supply to the belt memory; and when determining that the communication with the belt memory is in progress, immediately stop the communication with the belt memory.

7. The image forming apparatus according to claim 1, wherein the controller is further configured to start supplying the power from the drum power supply to the drum memory after starting supplying the power from the belt power supply to the belt memory.

8. The image forming apparatus according to claim 1, wherein the controller is further configured to:

detect whether the cover is in the open state or the closed state, when the drum cartridge and the belt unit are attached to the main body; and when detecting that the cover is in the closed state, start supplying the power from the drum power supply to the drum memory.

9. The image forming apparatus according to claim 8, wherein the controller is further configured to:

detect whether the drum cartridge is attached to the main body; and when detecting that the drum cartridge is attached to the main body and detecting that the cover is in the closed state, start supplying the power from the drum power supply to the drum memory.

10. The image forming apparatus according to claim 1, wherein the controller is further configured to:

detect whether the cover is in the open state or the closed state, when the drum cartridge and the belt unit are attached to the main body; and when detecting that the cover is in the closed state, start supplying the power from the belt power supply to the belt memory.

11. The image forming apparatus according to claim 10, wherein the controller is further configured to:

detect whether the belt unit is attached to the main body; and start supplying the power from the belt power supply to the belt memory, when detecting that the belt unit is attached to the main body and detecting that the cover is in the closed state.

12. The image forming apparatus according to claim 1, further comprising one or more toner cartridges each of which is configured to be removably attached to the drum cartridge and store toner, each toner cartridge comprising a toner memory storing information regarding the toner.

13. The image forming apparatus according to claim 12, wherein the drum cartridge further comprises:

one or more toner connectors each configured to electrically connect with a corresponding one of the one or more toner cartridges in a state where the one or more toner cartridges are attached to the drum cartridge; and a drum circuit board electrically connected with the drum connector and the one or more toner connectors, wherein each toner memory is configured to electrically connect with the controller via a corresponding one of the one or more toner connectors, the drum circuit board, and the drum connector in a state where the drum cartridge to which the one or more toner cartridges are attached is attached to the main body.

14. A non-transitory computer-readable medium storing computer-readable instructions executable by a processor included in a controller of an image forming apparatus, the instructions being configured to, when executed by the processor, cause the controller to:

start supplying power from a drum power supply to a drum memory;

start supplying power from a belt power supply to a belt memory;

stop supplying the power from the drum power supply to the drum memory after starting supplying the power from the drum power supply to the drum memory; and stop supplying the power from the belt power supply to the belt memory after stopping supplying the power from the drum power supply to the drum memory when the controller is supplying the power from the drum power supply to the drum memory and is supplying the power from the belt power supply to the belt memory, wherein the image forming apparatus comprises a main body, a drum cartridge configured to be removably attached to the main body, the drum cartridge comprising, a photoconductive drum, the drum memory storing information regarding the photoconductive drum, and a drum connector electrically connected with the drum memory, a belt unit configured to be removably attached to the main body, the belt unit comprising a transfer belt configured to contact the photoconductive drum of the drum cartridge attached to the main body, the belt memory storing information regarding the transfer belt, and a belt connector electrically connected with the belt memory, and wherein the main body comprises the controller, a first connector configured to connect with the drum connector when the drum cartridge is attached to the main body, a second connector configured to connect with the belt connector when the belt unit is attached to the main body, the drum power supply configured to supply the power to the drum memory via the first connector and the drum connector when the drum connector is connected with the first connector, and the belt power supply configured to supply the power to the belt memory via the second connector and the belt connector when the belt connector is connected with the second connector.

15. An image forming apparatus comprising:

a main body;

a drum cartridge configured to be removably attached to the main body, the drum cartridge comprising a photoconductive drum, a drum memory storing information regarding the photoconductive drum, and a drum connector electrically connected with the drum memory;

a belt unit configured to be removably attached to the main body, the belt unit comprising a transfer belt configured to contact the photoconductive drum of the drum cartridge attached to the main body, a belt memory storing information regarding the transfer belt, and a belt connector electrically connected with the belt memory, wherein the main body comprises a first connector configured to connect with the drum connector when the drum cartridge is attached to the main body, a second connector configured to connect with the belt connector when the belt unit is attached to the main body, a drum power supply configured to supply power to the drum memory via the first connector and the drum connector when the drum connector is connected with the first connector, a belt power supply configured to supply power to the belt memory via the second connector and the belt connector when the belt connector is connected with the second connector, and a controller configured to start supplying power from the drum power supply to the drum memory, start supplying power from the belt power supply to the belt memory, stop supplying the power from the drum power supply to the drum memory after starting supplying the power from the drum power supply to the drum memory, and stop supplying the power from the belt power supply to the belt memory after stopping supplying the power from the drum power supply to the drum memory when the controller is supplying the power from the drum power supply to the drum memory and is supplying the power from the belt power supply to the belt memory.

* * * * *